US011548055B2

(12) United States Patent
Zou et al.

(10) Patent No.: US 11,548,055 B2
(45) Date of Patent: Jan. 10, 2023

(54) SYSTEMS AND METHODS FOR HEAT EXCHANGER MANUFACTURING

(71) Applicant: Rheem Manufacturing Company, Atlanta, GA (US)

(72) Inventors: Yang Zou, Dallas, TX (US); Sivakumar Gopalnarayanan, Plano, TX (US); Swapnil Khaire, Fayetteville, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 0 days.

(21) Appl. No.: 17/747,882

(22) Filed: May 18, 2022

(65) Prior Publication Data

US 2022/0274155 A1 Sep. 1, 2022

Related U.S. Application Data

(63) Continuation of application No. 16/990,293, filed on Aug. 11, 2020, now Pat. No. 11,338,353.

(51) Int. Cl.
*B21D 53/08* (2006.01)
*B21D 39/20* (2006.01)

(52) U.S. Cl.
CPC ..... *B21D 53/085* (2013.01); *B21D 39/20* (2013.01)

(58) Field of Classification Search
CPC .. B21D 26/041; B21D 26/033; B21D 53/085; B21D 39/20; B21D 39/203; B21D 39/206; Y10T 29/49364; Y10T 29/4938; Y10T 29/49938; Y10T 29/49911; Y10T 29/4994; Y10T 29/49805
See application file for complete search history.

(56) References Cited

U.S. PATENT DOCUMENTS

| | | | | |
|---|---|---|---|---|
| 4,055,063 | A | 10/1977 | Krips | |
| 4,083,093 | A * | 4/1978 | Chertok | B23P 15/26 29/890.033 |
| 4,470,280 | A | 9/1984 | Kelly | |
| 4,485,547 | A | 12/1984 | Busse | |
| 4,513,497 | A | 4/1985 | Finch | |
| 4,635,333 | A | 1/1987 | Finch | |
| 4,782,571 | A * | 11/1988 | Krips | B21D 39/06 29/523 |
| 4,889,679 | A * | 12/1989 | Snyder | G01N 27/902 29/890.044 |
| 5,027,507 | A * | 7/1991 | Nelson | B21D 39/06 29/523 |
| 5,033,190 | A * | 7/1991 | Gray | B21D 53/085 29/523 |
| 6,151,939 | A | 11/2000 | Hanna | |
| 10,737,308 | B2 | 8/2020 | Masek | |
| 2010/0116823 | A1 * | 5/2010 | Felsch | B21D 26/029 29/890.044 |

* cited by examiner

*Primary Examiner* — Jason L Vaughan
(74) *Attorney, Agent, or Firm* — Eversheds Sutherland (US) LLP

(57) ABSTRACT

Systems and methods for pressure expanding a tube to fit a heat exchanger fin are disclosed. The systems can include one or more pressure relief devices, and each pressure relief device can be configured to release at least some pressurized fluid via a respective auxiliary flow path in response to a pressure of the pressurized fluid being greater than a predetermined pressure relief threshold.

20 Claims, 4 Drawing Sheets

SYSTEMS AND METHODS FOR HEAT EXCHANGER MANUFACTURING

CROSS-REFERENCE TO RELATED APPLICATIONS

This application is a continuation of U.S. application Ser. No. 16/990,293, filed Aug. 11, 2020, which is incorporated herein by reference.

BACKGROUND

Conventional tube-and-fin heat exchangers are typically made using aluminum fins and copper tubes that have an outer diameter of ⅜-inch (9.525 mm). Conventionally, a mechanical expansion process is used to attach the aluminum fins to the copper tubes. A bullet or sphere, which has a diameter that is slightly larger than the inner diameter of the tube, is pushed through the tube to expand the tube's wall outwardly, thereby forming an interference fit between the external surface of the tube and the fins.

Recently, efforts have been made to expand heat exchanger tubes using a fluid in lieu of a mechanical expansion process. Such pneumatic- and hydraulic-expansion methods generally require a high level of precision with respect to the pressure provided to the tubes. This is at least in part because there is a small window of pressure values at which a tube can be expanded without rupturing the tube. A certain amount of pressure is required to cause the tube material, which is traditionally copper, to become plastic and deformable such that the wall of the tube can become expanded. Too much, pressure, however, will cause the tube material to fail such that the tube ruptures.

As will be appreciated, decreasing the size of the tube wall can impact the failure threshold of the tube, which can increase the difficulty in manufacturing heat exchangers having tubes with a diameter less than ⅜ inch (e.g., 7 mm, 5 mm).

In addition, it can be desirable to use different materials for the tubes. For example, copper, which is traditionally used for heat exchanger tubes, can be an expensive material, and the use of cheaper materials could lower the materials cost of heat exchangers. For example, various alloys, such as aluminum, may provide adequate heat transfer properties, but such materials may also require precise amounts of pressure to adequately expand the tubes without causing the tubes to rupture or otherwise fail. Indeed, some materials may require a higher level of precision with pressure than is required for copper. For example, the rupture threshold for aluminum tubes is only approximately 30-40 psi higher than the plastic threshold. That is, there is a window of only approximately 30-40 psi in which an aluminum tube can be sufficiently expanded without rupturing the aluminum tube. Because of the small window of pressure values, there can a large number of tubes that are ruptured during manufacturing. This can be expensive and time-consuming as additional tubes must be expanded to replace any ruptured tubes.

Accordingly, there is a need for systems and methods that can increase the ease by which heat exchanger tubes can be expanded during heat exchanger manufacturing and/or can decrease the likelihood of a heat exchanger tube rupturing.

SUMMARY

These and other problems are be addressed by the technologies described herein. Examples of the present disclosure relate generally to methods for heat exchanger manufacturing and, more specifically, to methods for pressure expanding a tube to fit a heat exchanger fin.

The disclosed technology includes a pressure relief device for use in expanding a diameter of a heat exchanger tube. The pressure relief device can include an attachment portion configured to detachably attach to an open end of the heat exchanger tube, an inlet configured to receive pressurized fluid, and an outlet configured to output the pressurized fluid to the open end of the heat exchanger tube. The pressure relief device can include a primary flow path extending between the inlet and the outlet, and the pressure relief device can include a pressure relief component configured to divert at least some of the pressurized fluid from the primary flow path in response to a pressure of the pressurized fluid being greater than a predetermined pressure relief threshold.

The pressure relief component can be configured to divert the at least some of the pressurized fluid from the primary flow path to an auxiliary flow path that is different from the primary flow path.

The auxiliary flow path can output fluid to an ambient environment external to the pressure relief device.

The pressure relief component can be configured such that at least a portion of the pressure relief component is breached or broken or damaged when the pressure relief component diverts the at least some of the pressurized fluid from the primary flow path.

The pressure relief component can include a rupture disk or a rupture panel.

The pressure relief device can include a receiving portion configured to at least partially receive the rupture disk or the rupture panel. The receiving portion can be configured such that the rupture disk or the rupture panel can be removed when the rupture disk or the rupture panel becomes breached or broken or damaged. The receiving portion can be configured to receive a replacement rupture disk or a replacement rupture panel.

The pressure relief component can be configured to transition from a first configuration to a second configuration. The first configuration can correspond to (i) the pressure of the pressurized fluid being less than or equal to the predetermined pressure relief threshold and (ii) the pressurized fluid flowing along the primary flow path. The second configuration can correspond to (i) the pressure of the pressurized fluid being greater than the predetermined pressure relief threshold and (ii) at least some of the pressurized fluid flowing along an auxiliary flow path. The auxiliary flow path can be different from the primary flow path.

The pressure relief component can be configured to transition from the second configuration to the first configuration in response to the pressure of the pressurized fluid decreasing from a value that is greater than the predetermined pressure relief threshold to a value that is less than or equal to the predetermined pressure relief threshold.

The pressure relief component can include a pressure relief valve.

The pressure relief valve can be configured to transition between a fully closed position to a first open position when the pressure of the pressurized fluid increases above or decreases below a first predetermined pressure value. The pressure relief valve can be configured to transition between the first open position and a second open position when the pressure of the pressurized fluid increases above or decreases below a second predetermined pressure value. The second open position can correspond to an increased area of an opening in the pressure relief valve as compared to the first open position. The opening of the pressure relief valve can be in direct fluid communication with an auxiliary flow path, and the auxiliary flow can be different from the primary flow path.

The disclosed technology includes a heat exchanger tube expansion system that can include a tube expansion device in fluid communication with a pressurized fluid source. The tube expansion device can be configured to receive pressurized fluid from the pressurized fluid source and output the pressurized fluid to an interior of each of one or more heat exchanger tubes. The tube expansion device can include one or more pressure relief devices. Each pressure relief device can be configured to release at least some of the pressurized fluid via a respective auxiliary flow path in response to a pressure of the pressurized fluid being greater than a predetermined pressure relief threshold.

At least one of the respective auxiliary flow paths can output fluid to an ambient environment external to the heat exchanger tube expansion system.

The tube expansion device can include a collar configured to detachably attach to the one or more heat exchanger tubes. A pressure relief device of the one or more pressure relief devices can be located on a wall of the collar.

The heat exchanger tube expansion system can include a pressure relief device of the one or more pressure relief devices that is configured to detachably attach to an end of heat exchanger tube of the one or more heat exchanger tubes.

The pressure relief device can be a first pressure relief device of the one or more pressure relief devices and the end of the heat exchanger tube is a first end of the heat exchanger tube. The tube expansion device can include a second pressure relief device of the one or more pressure relief devices, and the second pressure relief device can be configured to detachably attach to a second end of the heat exchanger tube.

At least one of the one or more pressure relief devices can include a rupture disk or a rupture panel.

At least one of the one or more pressure relief devices can include a pressure relief valve.

At least one of the one or more pressure relief devices can include a sealing material configured to create a seal between the pressure relief device and a heat exchanger tube of the one or more heat exchanger tubes.

At least one of the one or more heat exchanger tubes can comprise or be made from aluminum.

At least one of the one or more heat exchanger tubes can have an external diameter that is less than or equal to approximately 7 mm.

The disclosed technology can include methods for expanding a diameter of a heat exchanger tube using one or more pressure relief devices and/or a tube expansion device.

Further features of the disclosed design, and the advantages offered thereby, are explained in greater detail hereinafter with reference to specific examples illustrated in the accompanying drawings, wherein like elements are indicated be like reference designators.

BRIEF DESCRIPTION OF THE DRAWINGS

Reference will now be made to the accompanying drawings, which are not necessarily drawn to scale, are incorporated into, and constitute a portion of, this disclosure, illustrate various implementations and aspects of the disclosed technology and, together with the description, serve to explain the principles of the disclosed technology. In the drawings.

DETAILED DESCRIPTION

Figure 1:
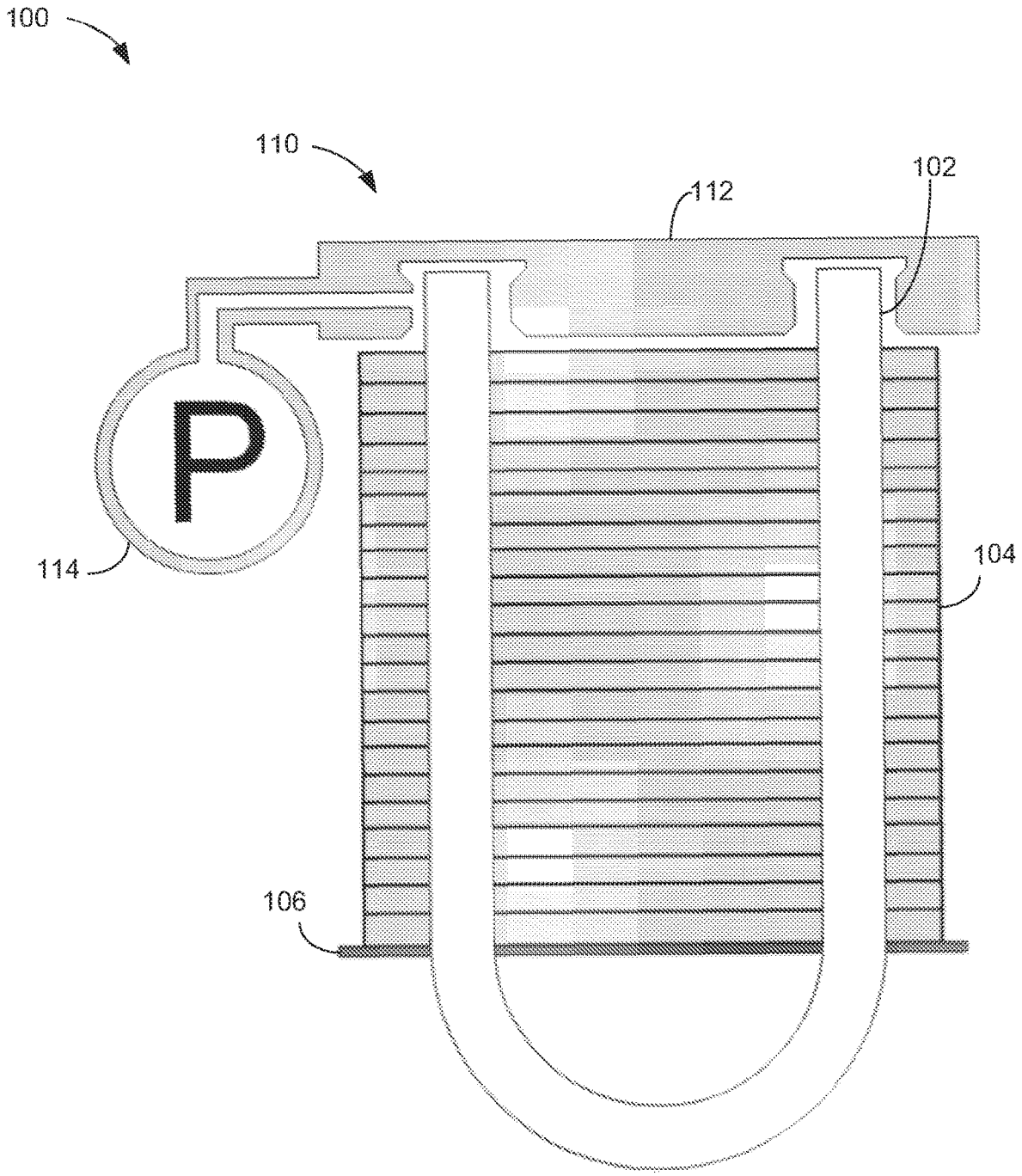
FIG. 1 PRIOR ART
FIG. 1 illustrates a schematic view of an example tube expansion system according to the prior art.

Throughout this disclosure, systems and methods are described with respect to pressure expanding a tube to fit a heat exchanger fin. Those having skill in the art will recognize that the disclosed technology can be applicable to multiple scenarios and applications.

Some implementations of the disclosed technology will be described more fully with reference to the accompanying drawings. This disclosed technology may, however, be embodied in many different forms and should not be construed as limited to the implementations set forth herein. The components described hereinafter as making up various elements of the disclosed technology are intended to be illustrative and not restrictive. Indeed, it is to be understood that other examples are contemplated. Many suitable components that would perform the same or similar functions as components described herein are intended to be embraced within the scope of the disclosed electronic devices and methods. Such other components not described herein may include, but are not limited to, for example, components developed after development of the disclosed technology.

Herein, the use of terms such as "having," "has," "including," or "includes" are open-ended and are intended to have the same meaning as terms such as "comprising" or "comprises" and not preclude the presence of other structure, material, or acts. Similarly, though the use of terms such as "can" or "may" are intended to be open-ended and to reflect that structure, material, or acts are not necessary, the failure to use such terms is not intended to reflect that structure, material, or acts are essential. To the extent that structure, material, or acts are presently considered to be essential, they are identified as such.

It is to be understood that the mention of one or more method steps does not preclude the presence of additional method steps or intervening method steps between those steps expressly identified. Similarly, it is also to be understood that the mention of one or more components in a device or system does not preclude the presence of additional components or intervening components between those components expressly identified.

As used herein, unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

As used herein, the phrases "expanding a tube," "causing a wall of the tube to expand," and the like refer to moving the walls of a tube radially outward such that the diameter of the tube increases.

Although the disclosed technology may be described herein with respect to various systems and methods, it is contemplated that embodiments or implementations of the disclosed technology with identical or substantially similar features may alternatively be implemented as methods or systems. For example, any aspects, elements, features, or the like described herein with respect to a method can be equally attributable to a system. As another example, any aspects, elements, features, or the like described herein with respect to a system can be equally attributable to a method.

Reference will now be made in detail to example embodiments of the disclosed technology, examples of which are illustrated in the accompanying drawings and disclosed herein. Wherever convenient, the same reference numbers will be used throughout the drawings to refer to the same or like parts.

As mentioned above, the pressure required to expand a tube can depend on the material of the tube, the thickness of the tube wall, and/or the diameter of the tube. Conventionally, copper tubes and/or aluminum have been used in heat exchangers. As will be appreciated, aluminum can be cheaper than copper while still providing desirable heat transfer properties. Traditionally, tubes were expanded using a piston or some other mechanical means. More recently, copper tubes have been expanded pneumatically, but there is greater difficulty in expanding aluminum tubes pneumatically, which can be owed to, as an example, increased difficulty in providing sufficient pressure for expansion of the aluminum tubes without providing so much pressure the aluminum tubes fail. In addition, conventional heat exchanger tubes have an approximately ⅜-inch (approximately 9.525 mm) diameter, but there can be circumstances in which it is desirable or necessary to use smaller tubes, such as tubes having a diameter that is approximately 7 mm or tubes having a diameter that is approximately 5 mm.

Referring to FIG. 1, conventional processes include feeding tubes 102 through an arrangement of fins 104 (i.e., through apertures in the fins 104) and apertures in a tube sheet 106. The open ends of each tube 102 can be attached to a pressure expansion device 110 of a tube expansion system 100. The pressure expansion device 110 can include a collar 112 that can clamp and seal each open end of the tubes 102. A pressure source 114 can then force a high pressure fluid (e.g., air, water) into the interior of the tubes 102, thereby expanding the tube walls outward to create an interference fit between the exterior of the tubes 102 and the fins 104 and between the exterior of the tubes 102 and the tube sheet 106.

As explained above, by providing interior pressure at or above the plastic limit, the tube wall can be pushed outwardly such that the tube material can achieve a new shape. Specifically, the tube wall can be pushed outwardly, thereby causing an external surface of the tube to contact, and form an interference fit with, one or more fins disposed along the tube. The plastic limit or threshold for the aluminum tubes can be approximately 2600 psig for an approximately 7 mm-diameter tube and approximately 2000 psig for an approximately 5 mm-diameter tube. As will be appreciated, the plastic limit can vary based on factors such as fin number and/or density (e.g., fins per inch) and fin material.

Applying too much pressure, however, can cause the tube to rupture. Thus, the pressure provided to the tubes must remain below the failure point of the corresponding tubes. The failure point or threshold for the aluminum tubes can be approximately 3000 psig for an approximately 7 mm-diameter tube and approximately 2400 psig for an approximately 5 mm-diameter tube, depending also on other factors such as those described herein. Accordingly, the target pressure range for expanding an aluminum, approximately 7 mm-diameter tube can be in a range from approximately 2400 psig to approximately 3000 psig, and the target pressure range for expanding an aluminum, approximately 5 mm-diameter tube can be in a range from approximately 2000 psig to approximately 2400 psig.

Consistently providing high pressure in such a small window of permissible variation can be difficult. If the pressure is too low, the tubes will not expand, and the fins will not become attached to the tubes. If the pressure is too high, the tubes will expand too much and rupture. Referring to FIG. 2, such concerns can be alleviated with the use of a pressure relief device 220 of a tube expansion system 200. Accordingly, it can be advantageous to use a pressure relief device to permit the safe escape of pressurized fluid that has a pressure greater than a predetermined release threshold, and the predetermined release threshold can be less than the failure point or failure threshold of the tubes. Accordingly, the chance of tubes rupturing can be reduced or eliminated.

The tubes 102 can be fed through an arrangement of fins 104 and apertures in a tube sheet 106. The fins 104 can each include one or more holes, and a corresponding tube 102 can be fed through each hole such that a number of fins 104 are arranged on the tubes 102. A pressure expansion device 210 can be configured to provide pressurized fluid from a pressure source 214 into the interior of the tubes 102. The collar 212 of the pressure expansion device 210 can include a sealing material to help form a seal between the pressure expansion device 210 and the tubes 102 and/or between the pressure expansion device 210 and the pressure relief device 220. The sealing material can include, but is not limited to, EPDM rubber, a thermoplastic elastomer (TPE) mix of plastic and rubber, a thermoplastic olefin (TPO) polymer/filler blend silicone, and the like.

Figure 2A:
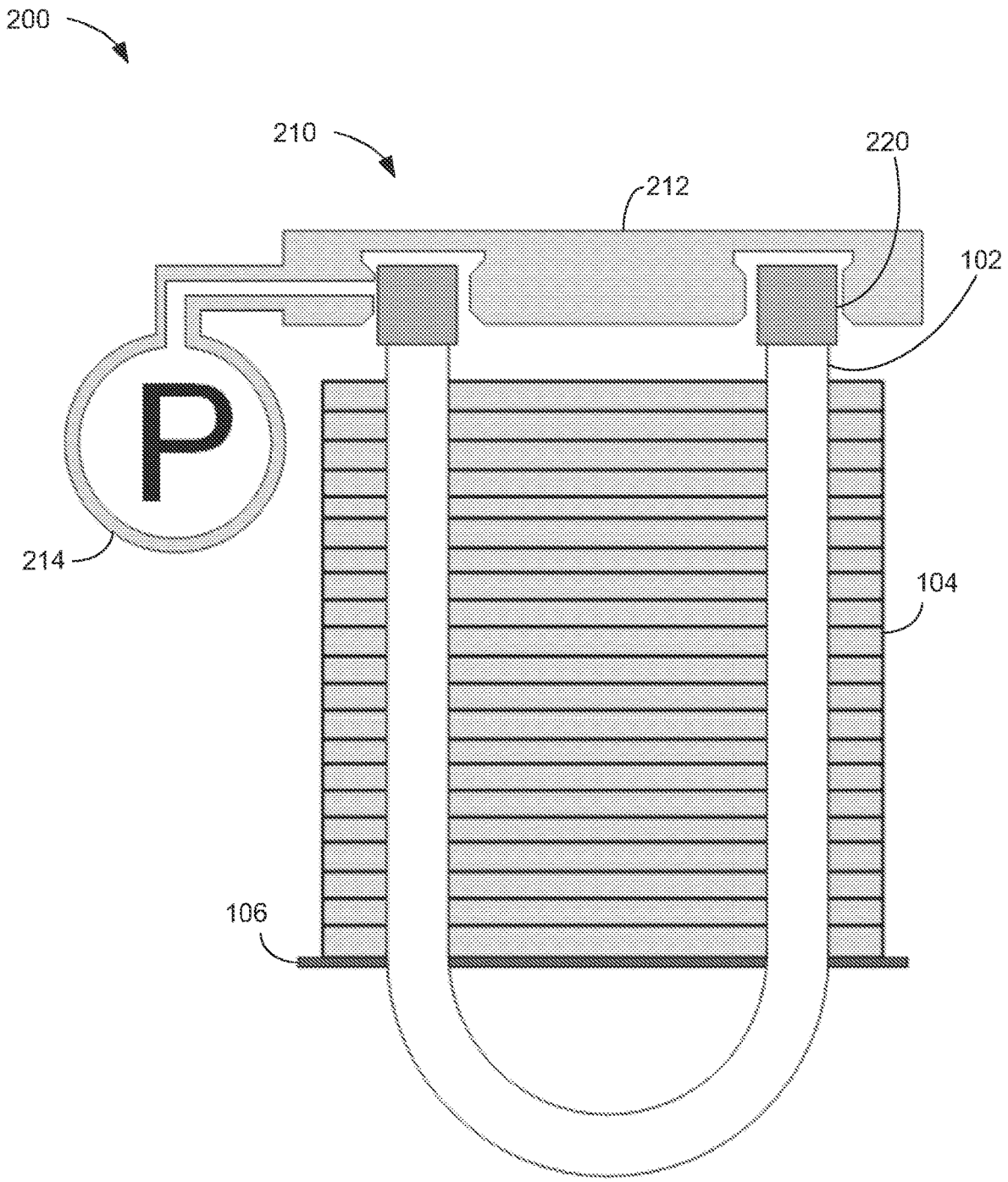
FIGS. 2A-2C illustrate schematic views of example tube expansion systems, in accordance with the disclosed technology.
Figure 2B:
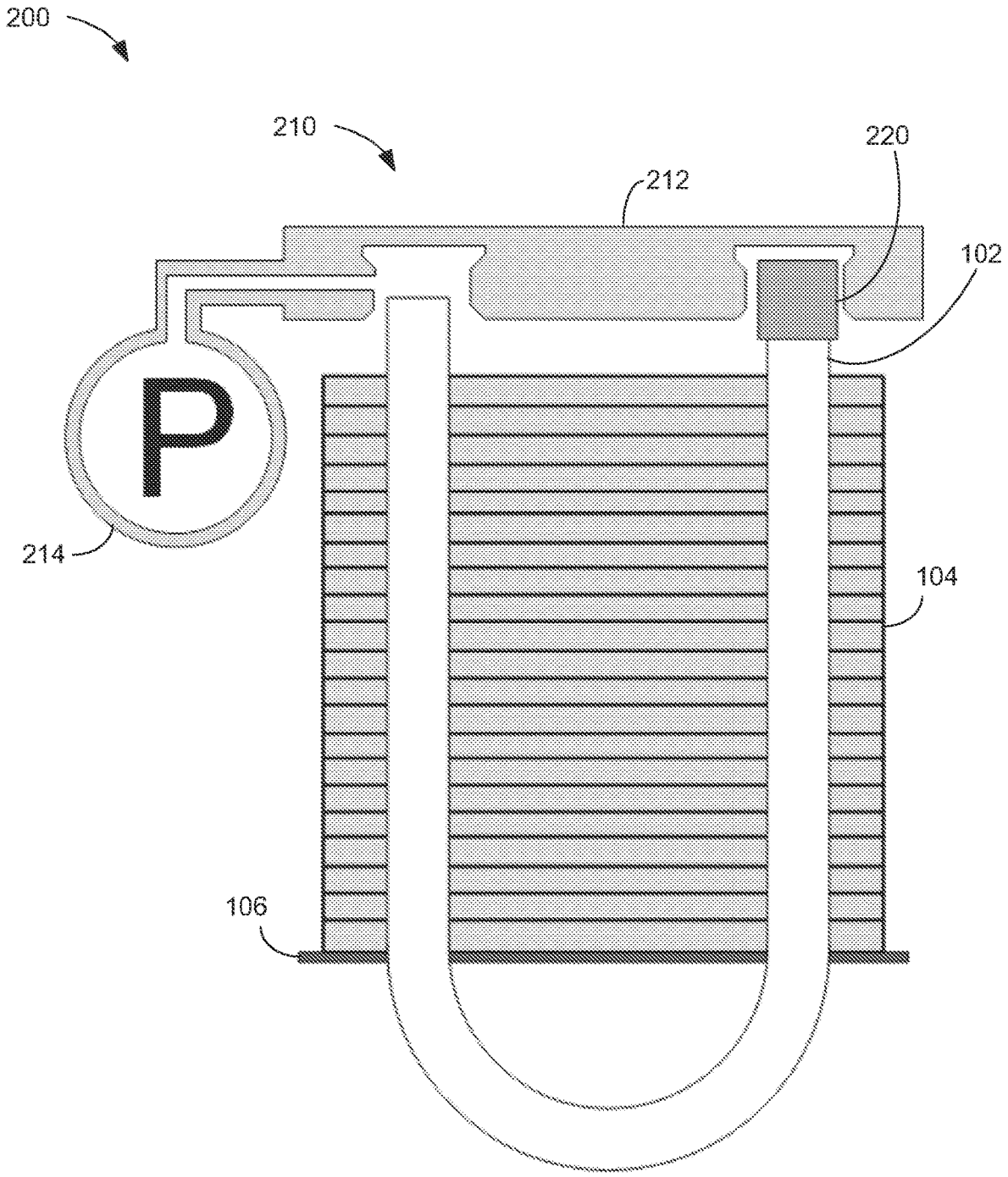

As shown in FIG. 2A, the tube expansion system 200 can be configured such that a pressure relief device 220 can be attached to both open ends of a hairpin tube (also referred to as a U-bend tube). Alternatively, as illustrated in FIG. 2B, the tube expansion system 200 can be configured such that only a single pressure relief device 220 is necessary. That is, a pressure relief device 220 can be attached to one of the open ends of a given tube 102, while the other open end of the tube 102 can be in direct fluid communication with the collar 212 of the pressure expansion device 210.

Figure 2C:
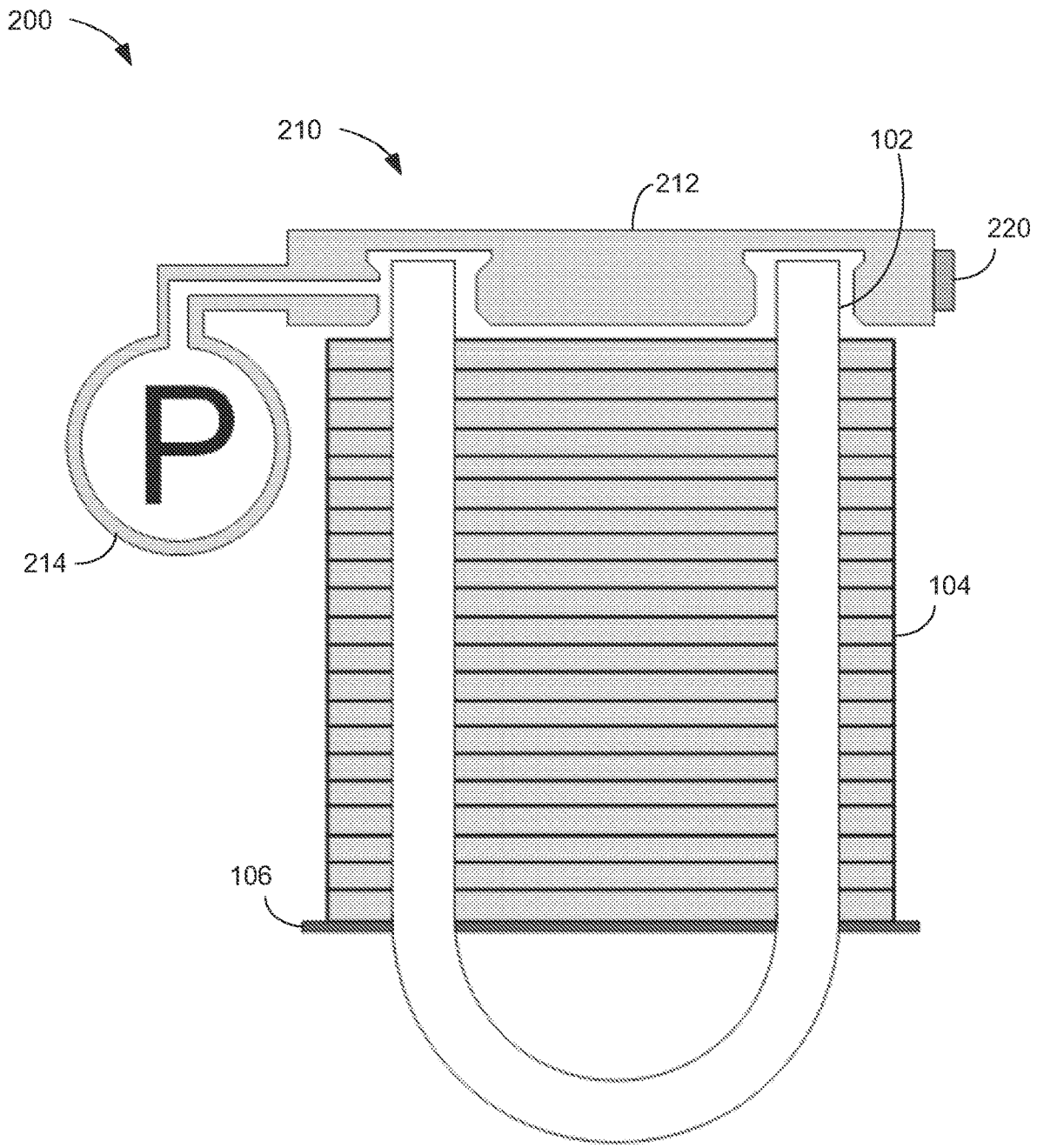

Additionally or alternatively, referring to FIG. 2C, the collar 212 can itself include a pressure relief device 220. Accordingly, a pressure relief device 220 can be provided without necessitating a pressure relief device 220 be connected to each tube 102 or each end of a tube 102. That being said, the tube expansion system 200 can include multiple pressure relief devices 220 to provide redundant protection of the tubes. For example, the collar 212 can include one or more pressure relief devices 220, and/or a pressure relief device 220 can be attached to all, one, or none of the open ends of the tubes 102.

The pressure relief device 220 can be a sacrificial pressure relief device 220. That is, the pressure relief device 220 can be configured to be used a single time. Alternatively, the sacrificial pressure relief device 220 can be configured to release pressure a single time (e.g., the sacrificial pressure relief device 220 can be used for multiple instances of expanding tubes but can fail or otherwise release pressure from the tube 102 and/or system 200 only a single time).

Alternatively, the pressure relief device 220 can be configured to be reusable such that the pressure relief device 220 can be used for multiple instances of expanding tubes and can release pressure from the tube 102 and/or system 200 multiple times. As discussed more fully herein, the reusable pressure relief device 220 can be configured to be reset and/or a disposable release portion of the reusable pressure relief device 220 can be replaced for subsequent use.

The pressure relief devices 220 can include a sealing material to help form a seal between the pressure relief devices 220 and the tubes 102. The sealing material can include, but is not limited to, EPDM rubber, a thermoplastic elastomer (TPE) mix of plastic and rubber, a thermoplastic olefin (TPO) polymer/filler blend silicone, and the like. The sealing material can be located on an external surface of the pressure relief device 220 (e.g., if the pressure relief device 220 is configured to insert into the tube 102, or the sealing material can be located on an internal surface of the pressure relief device 220 (e.g., if the pressure relief device 220 includes a recess configured to receive a portion of the tube 102).

The pressure relief device 220 (e.g., a pressure relief device 220 configured to attach to an end of a tube 102) can provide a primary flow path extending between an inlet and an outlet of the pressure relief device 220. The inlet can be configured to receive the pressurized fluid from the pressure source 214, and the outlet can be configured to output the pressurized fluid to the interior of the tube 102. The pressure relief device can include a pressure relief component configured to divert at least some pressurized fluid from the primary flow path to an auxiliary flow path if the pressure of the pressurized fluid is greater than a predetermined pressure relief threshold. As described more fully herein, the pressure relief component can include a pressure relief valve, a rupture panel, or the like.

If the pressure relief device 220 includes a pressure relief valve (also referred to as a safety relief valve), the pressure relief valve can include a primary flow path, through which pressurized fluid can be moved from the fluid source 214 to the interior of the tube 102, and an auxiliary flow path that is normally closed. The pressure relief valve can be configured to open the auxiliary flow path when the pressure within the pressure relief valve exceeds a predetermined pressure relief threshold, thereby diverting pressurized fluid away from the tube 102 and decreasing the internal pressure within the tube 102. The predetermined pressure relief threshold can be less than the failure or rupture threshold of the tube 102, such that at least some of the pressurized fluid can be diverted away from the tube 102, which can prevent the tube 102 from rupturing.

The pressure relief valve can be binary such that the auxiliary flow path is fully closed when the pressure of the pressurized fluid is less than or equal to the predetermined pressure relief threshold and the auxiliary flow path is fully open when the pressure of the pressurized fluid is greater than the predetermined pressure relief threshold.

Alternatively, the pressure relief valve can be configured to open or close incrementally (e.g., continuously, in steps). That is, the pressure relief valve can be configured to open or close according to a predetermined pressure relief range. For example, when the pressure of the pressurized fluid is below a lower limit of the predetermined pressure relief range, the auxiliary flow path can be fully closed. When the pressure of the pressurized fluid is equal to the lower limit of the predetermined pressure relief range, the pressure relief valve can open to a first open position. When the pressure of the pressurized fluid is equal to or greater an upper limit of the predetermined pressure relief range, the pressure relief valve can open to a second open position (e.g., corresponding to the auxiliary flow path being fully open). When the pressure of the pressurized fluid is a value between the lower and upper limits of the predetermined pressure relief range, the valve can open to a third open position. The third open position can be an intermediate position that is more open than the first position (e.g., a greater area of open space is provided as compared to the first position such that an increased amount or flow rate of the pressurized fluid is permitted to flow along the auxiliary flow path as compared to when the valve is at the first position) and less open the second position (e.g., a smaller area of open space is provided as compared to the second position such that an decreased amount or flow rate of the pressurized fluid is permitted to flow along the auxiliary flow path as compared to when the valve is at the second position). Although the pressure relief valve is described as having three distinct positions, the pressure relief valve can have any number of positions, such as five, ten, fifteen, twenty, fifty, or one-hundred, as non-limiting examples. Each position can be a discrete increase in the amount of "openness," or the pressure relief valve can be configured to continuously or non-discretely transition between a fully open position and a fully closed position.

If the pressure relief valve is located between the collar 212 and the pressure source or within the pressure expansion device 210 between the pressure source 214 and the tube 102, the pressure relief valve can include both a primary flow path and an auxiliary flow path as described above, as pressurized fluid can then freely flow from the pressure source 214, through the pressure relief valve, and to the tube 102. If, however, the pressure relief valve is not located between the pressure source 214 and the tube 102 (e.g., at the location shown in FIG. 2C), the pressure relief valve need not include a primary flow path. That is, the pressure relief valve can optionally include only a relief flow passage through which pressurized fluid can flow if the pressure of the pressurized fluid is greater than a pressure relief threshold of the pressure relief valve.

Alternatively or additionally, the pressure relief device 220 can include a material having a failure or rupture threshold that is less than the failure or rupture threshold of the tubes 102. Thus, the material can be configured to permit at least some of the pressurized fluid to become diverted away from the tube 102, thereby decreasing the internal pressure within the tube 102, which can prevent the tube 102 from rupturing. The material can comprise carbon steel, stainless steel, hastelloy, graphite, copper, aluminum or the like, and the material can have any thickness, such that the material has an ultimate tensile stress that is less than the failure or rupture threshold of the tube 102.

For example, the pressure relief device 220 can comprise a rupture disk or rupture panel that is configured to rupture or fail at a predetermined pressure. The pressure relief device can include a slit, slot, hole, or recess that can be configured to receive a rupture panel or similar component. Thus, once a particular rupture panel ruptures, the ruptured rupture panel can be replaced with a new rupture panel by sliding or otherwise attaching the new rupture panel to the pressure relief device 220.

In this description, numerous specific details have been set forth. It is to be understood, however, that implementations of the disclosed technology may be practiced without these specific details. In other instances, well-known methods, structures, and techniques have not been shown in detail in order not to obscure an understanding of this description. References to "one embodiment," "an embodiment," "one example," "an example," "some examples," "example embodiment," "various examples," "one implementation," "an implementation," "example implementation," "various implementations," "some implementations," etc., indicate that the implementation(s) of the disclosed technology so described may include a particular feature, structure, or characteristic, but not every implementation necessarily includes the particular feature, structure, or characteristic.

Further, repeated use of the phrase "in one implementation" does not necessarily refer to the same implementation, although it may.

Further, certain methods and processes are described herein. It is contemplated that the disclosed methods and processes can include, but do not necessarily include, all steps discussed herein. That is, methods and processes in accordance with the disclosed technology can include some of the disclosed while omitting others. Moreover, methods and processes in accordance with the disclosed technology can include other steps not expressly described herein.

Throughout the specification and the claims, the following terms take at least the meanings explicitly associated herein, unless otherwise indicated. The term "or" is intended to mean an inclusive "or." Further, the terms "a," "an," and "the" are intended to mean one or more unless specified otherwise or clear from the context to be directed to a singular form. By "comprising," "containing," or "including" it is meant that at least the named element, or method step is present in article or method, but does not exclude the presence of other elements or method steps, even if the other such elements or method steps have the same function as what is named.

As used herein, unless otherwise specified the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

While certain examples of this disclosure have been described in connection with what is presently considered to be the most practical and various examples, it is to be understood that this disclosure is not to be limited to the disclosed examples, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain examples of the technology and also to enable any person skilled in the art to practice certain examples of this technology, including making and using any apparatuses or systems and performing any incorporated methods. The patentable scope of certain examples of the technology is defined in the claims and may include other examples that occur to those skilled in the art. Such other examples are intended to be within the scope of the claims if they have structural elements that do not differ from the literal language of the claims, or if they include equivalent structural elements with insubstantial differences from the literal language of the claims.

That which is claimed is:

1. A heat exchanger tube expansion system comprising:

a tube expansion device in fluid communication with a pressurized fluid source, the tube expansion device being configured to receive pressurized fluid from the pressurized fluid source and output the pressurized fluid to an interior of each of one or more heat exchanger tubes, wherein the tube expansion device comprises one or more pressure relief devices, each pressure relief device being configured to release at least some of the pressurized fluid via a respective auxiliary flow path in response to a pressure of the pressurized fluid being greater than a predetermined pressure relief threshold, and wherein a pressure relief device of the one or more pressure relief devices is configured to detachably attach to an end of a heat exchanger tube of the one or more heat exchanger tubes.

2. The heat exchanger tube expansion system of claim 1, wherein at least one of the respective auxiliary flow paths outputs fluid to an ambient environment external to the heat exchanger tube expansion system.

3. The heat exchanger tube expansion system of claim 1, wherein:

the pressure relief device is a first pressure relief device of the one or more pressure relief devices, the end of the heat exchanger tube is a first end of the heat exchanger tube, and the tube expansion device further comprises a second pressure relief device of the one or more pressure relief devices, the second pressure relief device being configured to detachably attach to a second end of the heat exchanger tube.

4. The heat exchanger tube expansion system of claim 1, wherein at least one of the one or more pressure relief devices comprises a rupture disk or a rupture panel.

5. The heat exchanger tube expansion system of claim 1, wherein at least one of the one or more pressure relief devices comprises a pressure relief valve.

6. The heat exchanger tube expansion system of claim 1, wherein at least one of the one or more pressure relief devices comprises a sealing material configured to create a seal between the pressure relief device and a heat exchanger tube of the one or more heat exchanger tubes.

7. The heat exchanger tube expansion system of claim 1, wherein at least one of the one or more heat exchanger tubes comprises aluminum.

8. The heat exchanger tube expansion system of claim 1, wherein the at least one of the one or more heat exchanger tubes has an external diameter that is less than or equal to 7 mm.

9. The heat exchanger tube expansion system of claim 1, wherein the at least one of the one or more heat exchanger tubes has an external diameter that is approximately 7 mm.

10. The heat exchanger tube expansion system of claim 1, wherein at least one of the one or more pressure relief devices comprises a sealing material configured to create a seal between the pressure relief device and a heat exchanger tube of the one or more heat exchanger tubes.

11. A heat exchanger tube expansion system comprising:

a tube expansion device in fluid communication with a pressurized fluid source, the tube expansion device being configured to receive pressurized fluid from the pressurized fluid source and output the pressurized fluid to an interior of each of one or more aluminum heat exchanger tubes, wherein the tube expansion device comprises a pressure relief device configured to release at least a portion of the pressurized fluid via an auxiliary flow path, which is in fluid communication with an ambient environment external to the heat exchanger tube expansion system, in response to a pressure of the pressurized fluid exceeding a predetermined pressure relief threshold, wherein the pressure relief device is configured to detachably attach to an end of a heat exchanger tube of the one or more heat exchanger tubes.

12. The heat exchanger tube expansion system of claim 11, wherein:

the pressure relief device is a first pressure relief device and the end of the heat exchanger tube is a first end of the heat exchanger tube, and the tube expansion device further comprises a second pressure relief device configured to detachably attach to a second end of the heat exchanger tube.

13. The heat exchanger tube expansion system of claim 11, wherein the at least one of the one or more heat exchanger tubes has an external diameter that is less than or equal to 7 mm.

14. The heat exchanger tube expansion system of claim 11, wherein the at least one of the one or more heat exchanger tubes has an external diameter that is approximately 7 mm.

15. The heat exchanger tube expansion system of claim 11, wherein the pressure relief device comprises a rupture disk or a rupture panel.

16. The heat exchanger tube expansion system of claim 11, wherein the pressure relief device comprises a pressure relief valve.

17. A heat exchanger tube expansion system comprising:

a tube expansion device in fluid communication with a pressurized fluid source, the tube expansion device being configured to receive pressurized fluid from the pressurized fluid source and output the pressurized fluid to an interior of each of one or more aluminum heat exchanger tubes having an external diameter that is less than or equal to 7 mm, wherein the tube expansion device comprises a pressure relief device configured to release at least a portion of the pressurized fluid via an auxiliary flow path, which is in fluid communication with an ambient environment external to the heat exchanger tube expansion system, in response to a pressure of the pressurized fluid exceeding a predetermined pressure relief threshold, wherein the pressure relief device is configured to detachably attach to an end of a heat exchanger tube of the one or more heat exchanger tubes.

18. The heat exchanger tube expansion system of claim 17, wherein:

the pressure relief device is a first pressure relief device and the end of the heat exchanger tube is a first end of the heat exchanger tube, and the tube expansion device further comprises a second pressure relief device configured to detachably attach to a second end of the heat exchanger tube.

19. The heat exchanger tube expansion system of claim 18, wherein the pressure relief device comprises a rupture disk or a rupture panel.

20. The heat exchanger tube expansion system of claim 18, wherein the pressure relief device comprises a pressure relief valve.

* * * * *